US009182187B1

(12) United States Patent
Griffith

(10) Patent No.: US 9,182,187 B1
(45) Date of Patent: Nov. 10, 2015

(54) INTEGRATED MUZZLE ADAPTER COUPLING SYSTEM

(71) Applicant: James Griffith, Jensen Beach, FL (US)

(72) Inventor: James Griffith, Jensen Beach, FL (US)

( * ) Notice: Subject to any disclaimer, the term of this patent is extended or adjusted under 35 U.S.C. 154(b) by 0 days.

(21) Appl. No.: 14/556,696

(22) Filed: Dec. 1, 2014

(51) Int. Cl.
*F41A 15/00* (2006.01)
*F41A 21/32* (2006.01)

(52) U.S. Cl.
CPC ..... *F41A 21/32* (2013.01)

(58) Field of Classification Search
USPC ..... 42/90, 106; 89/14.3, 14.4, 14.5
See application file for complete search history.

(56) References Cited

U.S. PATENT DOCUMENTS 5,433,133 A * 7/1995 La France ..... F41A 21/325 89/14.2
7,789,009 B1 * 9/2010 Brittingham ..... F41A 21/30 181/223
8,714,301 B2 * 5/2014 Shults ..... F41A 21/30 181/223
8,997,621 B1 * 4/2015 Dater ..... F41A 21/325 89/14.3
2015/0090105 A1 * 4/2015 Pace ..... F41A 21/30 89/14.4
2015/0135575 A1 * 5/2015 Wood, Jr. ..... F41A 21/325 42/90

* cited by examiner

*Primary Examiner* — John Woodrow Eldred

(74) *Attorney, Agent, or Firm* — Brian S. Steinberger; Law Offices of Brian S. Steinberger, P.A.

(57) ABSTRACT

Devices, systems, and methods for adding a coupling system onto the existing accessory thread on a rifle barrel, which allows for existing terminal muzzle devices (such as but not limited to muzzle brakes, flash hiders, muzzle suppressors, and the like) to remain on the barrel and not be removed when accessory devices, such as but not limited to silencers, percussion shrouds, golf ball launchers, tennis ball launchers, cartridge oil filters, and the like, are used with threaded gun barrels.

16 Claims, 13 Drawing Sheets

INTEGRATED MUZZLE ADAPTER COUPLING SYSTEM

FIELD OF INVENTION

This invention relates to firearms, and in particular to devices, systems, and methods for adding a coupling system onto the existing accessory thread on a rifle barrel, which allows for existing terminal muzzle devices (such as muzzle brakes, flash hiders, muzzle suppressors, and the like) to remain on the barrel and not be removed when accessory devices, such as but not limited to silencers, percussion shrouds, Golf Ball Launchers, tennis ball launchers, cartridge oil, fuel or hydraulic filters and the like (hereby called "accessory devices"), are used with threaded gun barrels.

BACKGROUND AND PRIOR ART

Firearm rifles, such as but not limited to an AK-47, AR-15, M-16, 300 Blackout, and other threaded barrel rifles or pistols, will often have terminal muzzle devices such as but not limited to muzzle brakes, flash hiders, muzzle suppressors, and the like, to be attached to the threaded end of the rifle barrel. When the user wishes to use accessory devices, such as a silencer, it is generally necessary that each terminal device must be removed from the barrel in order to allow for the accessory devices such as silencers, shrouds or launchers to be used.

Having to remove the terminal devices in order to add an accessory device results in an unnecessary inconvenience creating interference and delays to the normal operations of the weapon. Additionally, requiring tooling for the removal and re-assembly of the terminal devices plus the replacement of consumables (aka Crush Washers) caused by the removal and reassembly of the terminal devices. While this problem is undesirable for civilians, the undesirable problem of having to remove terminal devices especially increases for law enforcement, and military personnel.

Thus, the need exists for solutions to the above problems with the prior art.

SUMMARY OF THE INVENTION

A primary objective of the present invention is to provide devices, systems, and methods for adding a coupling system onto the existing accessory threads on a rifle barrel, which allows for existing terminal muzzle devices (such as muzzle brakes, flash hiders, muzzle suppressors, and the like) to remain on the barrel and not be removed when accessory devices, such as but not limited to silencers, percussion shrouds, golf ball and tennis ball launchers, cartridge oil filter and the like, are used with the gun barrel.

A secondary objective of the present invention is to provide devices, systems, and methods for adding a coupling system onto the existing accessory threads on a rifle barrel, which causes no interference with the normal operations of the weapon that have existing terminal devices installed on the weapons.

A third objective of the present invention is to provide devices, systems, and methods for adding a coupling system onto the existing accessory threads on a rifle barrel, to use with barrel accessories which do not interfere with passage of the projectile of the weapon whatsoever.

A fourth objective of the present invention is to provide devices, systems, and methods for adding a coupling system onto the existing accessory threads on a rifle barrel, by presenting a new male threaded area increasing the options and designs for additional novel accessories not currently made including ease of use for those accessories without the need to remove or re-install existing terminal muzzle devices.

An embodiment of the adapter system for allowing accessory devices to be attached to rifle barrels, while leaving terminal devices on the rifle barrel, can include a hollow adapter having a socket end with internal threads and an exterior grip portion about an exterior perimeter, the adapter having a first exterior threaded shaft having a first exterior diameter and a second exterior threaded shaft extending from the first exterior threaded shaft, the second exterior threaded shaft having an exterior diameter less than the first exterior diameter of the first exterior threaded shaft, wherein the socket end threadably attaches about accessory threads on a rifle barrel. The embodiment can be used with a terminal device attached to the second exterior threaded shaft, the terminal device selected from at least one of a muzzle brake, a flash hider and a muzzle suppressor, and an accessory device attached to the first exterior threaded shaft on the adapter.

The accessory device can include an interior threaded protective sleeve for covering the first exterior threaded shaft.

The accessory device can include a silencer adapter having a threaded socket end for rotating about and covering the first exterior threaded shaft of the adapter, and a protruding outer end having threaded surface for fitting within a threaded socket end of a silencer.

The accessory device can include a percussion shroud having a threaded socket end for rotating about and covering the first exterior threaded shaft of the adapter.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation. In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

1 Adapter system
10 Universal IMACS (integrated muzzle adapter coupling system) adapter (adapter component).
20 Standard outside accessory thread on IMACS adapter (this threading is subject to change to generally match the barrel threading)
25 IMACS accessory thread protector.
30 Crush washer(s).
35 IMACS inside accessory thread on thread protector.
40 Rifle barrel (Prior Art).
50 Standard outside accessory thread on rifle barrel.
60 Muzzle brakes, flash hiders, muzzle suppressors, and the like (Prior Art).
70 IMACS outside accessory thread on IMACS adapter.
80 Standard inside accessory thread on IMACS adapter (Prior Art).
90 IMACS silencer adapter.
100 Standard inside accessory thread on muzzle brake (Prior Art).
110 Flats on IMACS adapter for tightening.
120 Silencer (Prior Art).
130 IMACS inside accessory thread on silencer adapter.
140 Flats on silencer adapter for tightening (the current design is a hex but the purpose is for tightening).
150 Standard inside accessory thread on silencer (Prior Art).
160 IMACS percussion shroud.
170 IMACS inside accessory thread on percussion shroud.
180 Standard cartridge oil filter.
190 Standard inside thread in oil filter.

Figure 1:
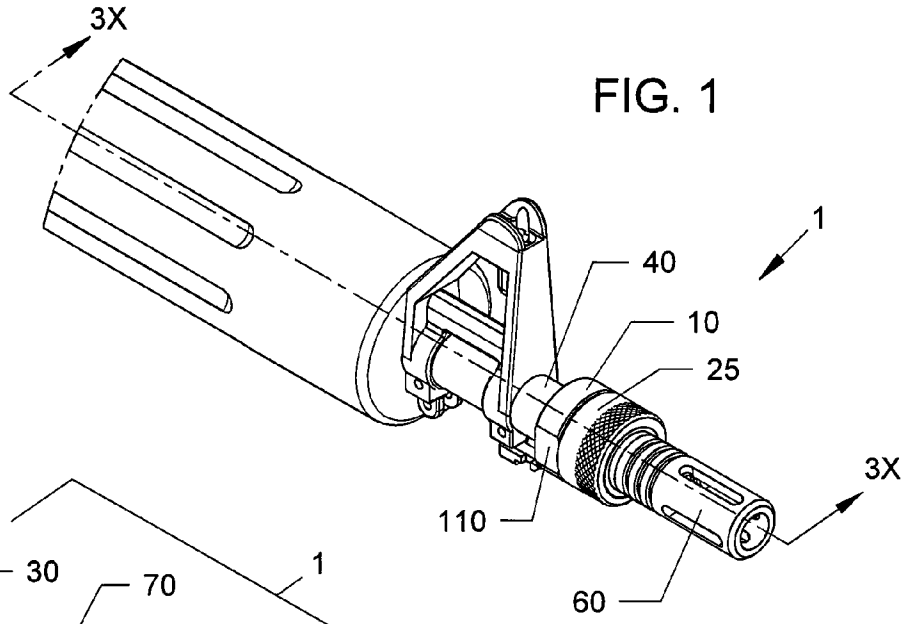
FIG. 1 is a top perspective view of the adapter system with adapter and thread protector mounted to the firearm barrel.
Figure 2:
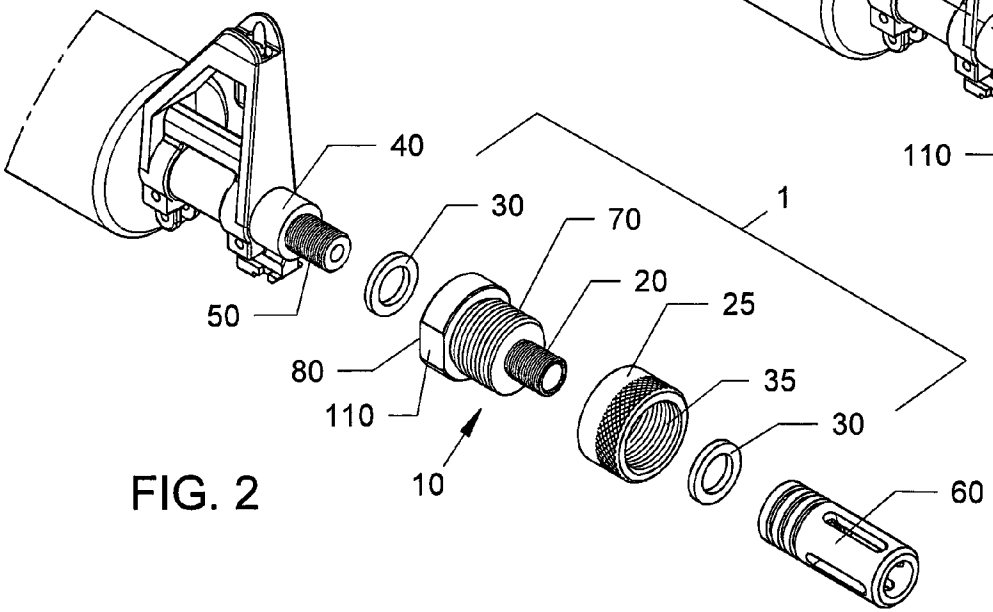
FIG. 2 is an exploded view of the adapter system of FIG. 1

FIG. 1 is a top perspective view of the adapter system 1 with adapter 10 and thread protector 25 mounted to the firearm barrel 40. FIG. 2 is an exploded view of the adapter system 1 components of FIG. 1 FIG. 3 is a cross-sectional view of the adapter system 1 mounted to the firearm barrel 40 and accessory thread 50 of FIG. 1 along arrows 3X.

Figure 3:
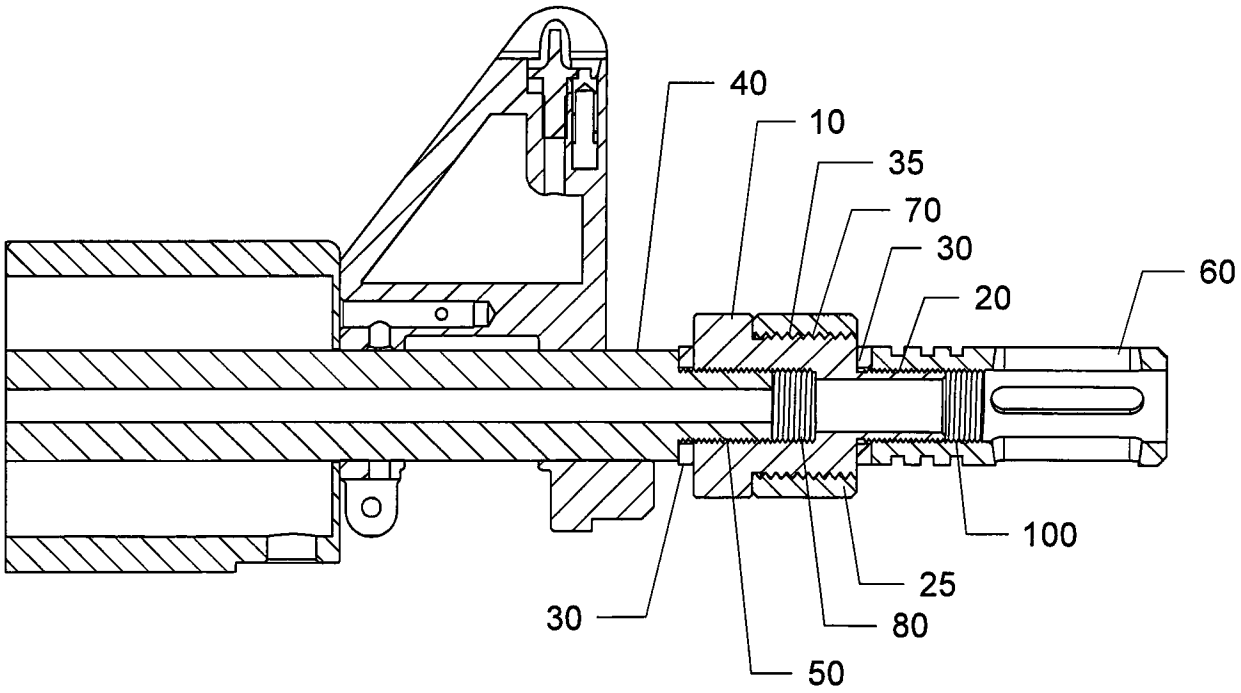
FIG. 3 is a cross-sectional view of the adapter system mounted to the firearm of FIG. 1 along arrows 3X.

Referring to FIGS. 1-3, the adapter system 1 can include a universal IMACS (integrated muzzle adapter coupling system) adapter 10, with crush washer(s) 30, IMACS accessory thread protector 25, that attach on one end to the standard outside accessory thread 50 on a rifle barrel 40, and on the other end allow for a muzzle brake 60 to be attached.

Initially a first crush washer 30 can be slipped over the standard outside accessory threads 50 on an existing rifle barrel 40. The threaded socket end (80) of the adapter 10 can then be tightened over the accessory threads 50, by the flats 110 on the adapter 10 by using tools, such as a wrench, and the like. An accessory thread protector 25 having internal threads 35 can be rotated over the outside accessory thread 70 on the adapter 10.

Next, another crush washer 30 can be slipped over the outward protruding shaft threads 20 on the adapter 10. Finally, the root socket end with internal threads 100 of the muzzle brake 60 can be rotated over the threaded shaft 20 of the adapter, and tightened in place.

Adapter 10

Figure 5:
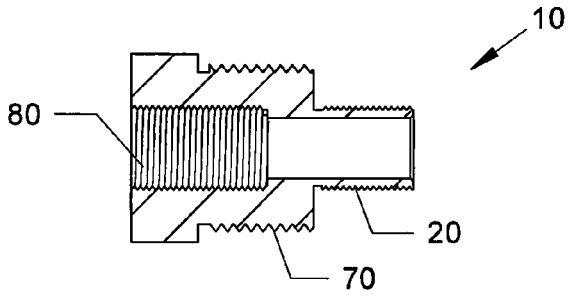
FIG. 5 is a cross-sectional view of the adapter component of FIG. 4 along arrows 5X.
Figure 6:
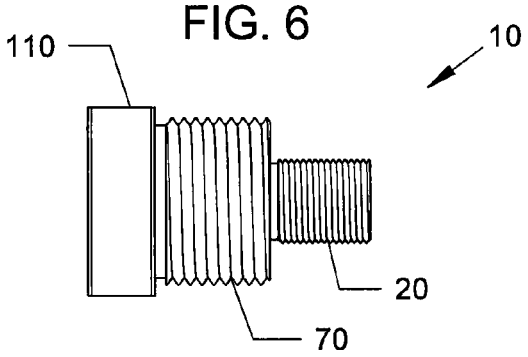
FIG. 6 is a top view of the adapter component of FIG. 4 along arrow 6X.
Figure 7:
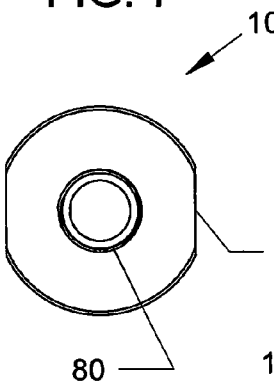
FIG. 7 is a left side view of the adapter component of FIG. 4.
Figure 4:
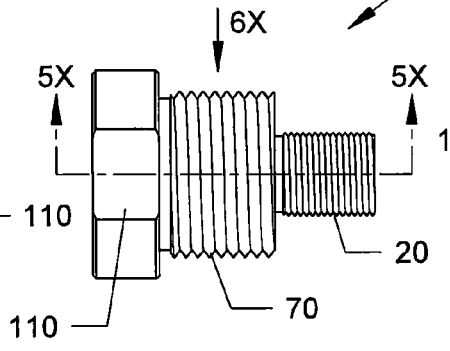
FIG. 4 is an enlarged front side view of the adapter component used with the adapter system and firearm barrel of FIGS. 1-3.

FIG. 4 is an enlarged front view of the adapter component 10 used with the adapter system 1 and firearm barrel 40 of FIGS. 1-3. FIG. 5 is a cross-sectional view of the adapter component 10 of FIG. 4 along arrows 5X. FIG. 6 is a top view of the adapter component 10 of FIG. 4 along arrow 6X. FIG.

Figure 8:
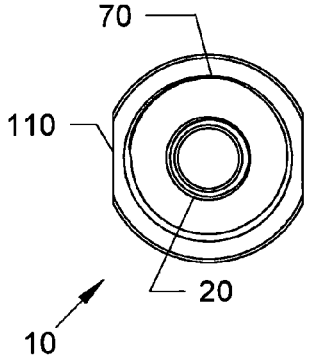
FIG. 8 is a right side view of the adapter component of FIG. 4.
Figure 9:
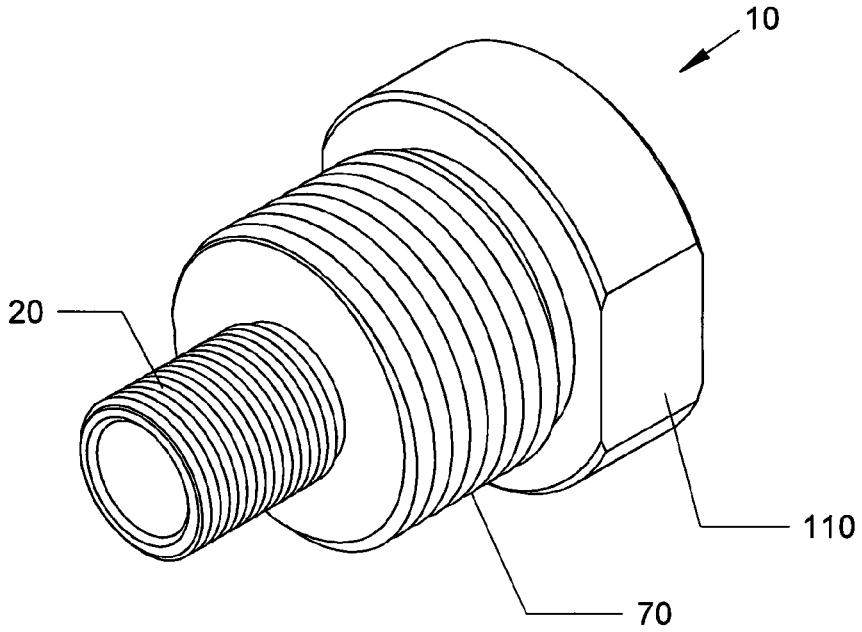
FIG. 9 is an enlarged top perspective view of the adapter component of FIGS. 4-8.
Figure 10:
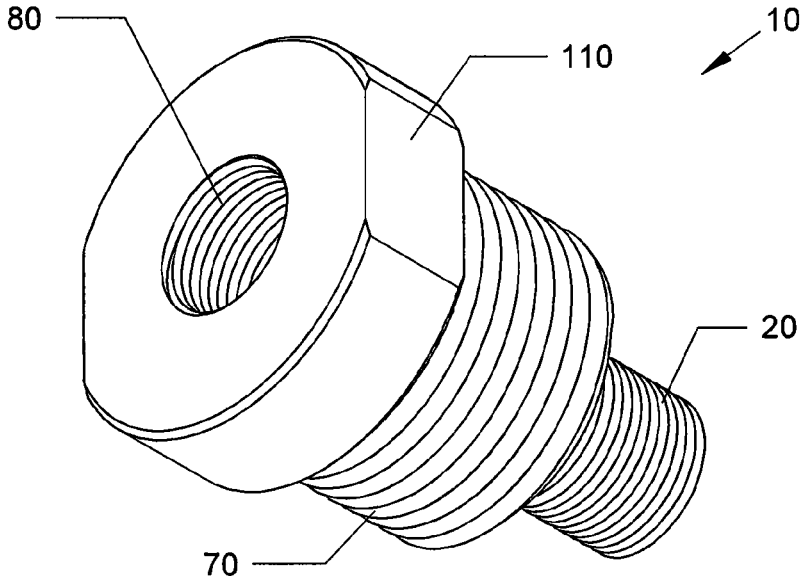
FIG. 10 is a perspective view of the adapter component of FIG. 9.

7 is a left side view of the adapter component 10 of FIG. 4. FIG. 8 is a right side view of the adapter component 10 of FIG. 4. FIG. 9 is an enlarged top perspective view of the adapter component 10 of FIGS. 4-8. FIG. 10 is a perspective view of the adapter component 10 of FIG. 9.

Referring to FIGS. 1-10, the adapter 10 can be completely hollow with a core size that is greater than the hollowed core size of the barrel 40 it is attached to. This allows the weapon's projectile free passage without touching or interfering whatsoever. The female threading 80 in the hollow cored section of the adapter 10 can be threaded to exactly match the barrel's male threaded stud 50 (FIG. 2) so it may be secured to the barrel utilizing an industry standard crush washer 30. The center body and opposite end 20 of the adapter can include 2 male threaded sections 70, 20 not of the same diameter as each other. The smaller and outermost male threaded section 20 can be an exact duplicate of the barrel's threaded stud 50 permitting for the original muzzle device 60 to be re-attached (via an industry standard crush washer or as the user desires).

Original terminal muzzle devices 60 are more commonly known by various names such as a muzzle brake, flash hider, muzzle suppressor, and the like.

The second and larger male threaded section 70 can be located in the center or body of the adapter 10. Its' diameter is deliberately greater than the muzzle brake 60 per a weapons caliber or gauge and what permits a host of various accessory muzzle devices to be attached and used without requiring the removal of the muzzle brake. This threaded section 70 is terminated by a larger flat section 110 or backstop acting as a natural nut or stop for anything threading onto the invention adapter 10. The Back stop can have a female indexing notch at the bottom 6 O'clock so accessory devices can provide a reciprocating male indexing tab allowing for accessory devices to be positioned, secured and locked to a desirable angle or clock setting on the weapon.

The novel adapter 10 can be available in 3 Barrel sized ½-28, ⅝-24 and 14m-1-LK(AK47). These are currently available in these 3 most popular sizes but more sizes are possible and have been requested). The novel adapter can work with any 1"-14 SAE or ¾" NPT threaded accessory device. If a 1" Nut fits over the muzzle brake, the adapter 10 will work for your setup (93" clearance) (the large accessory thread is just one size but other sizes can be made available to work with larger muzzle devices creating another variation of the same adapter).

Accessory Thread Protector 25

Figure 11:
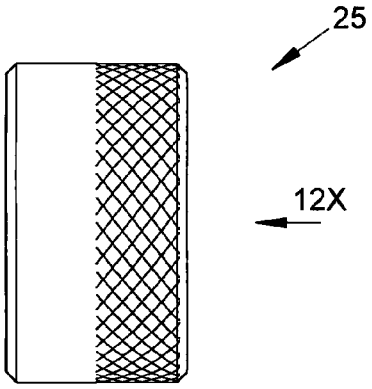
FIG. 11 is an enlarged side view of the thread protector used with the adapter system of FIGS. 1-2.
Figure 12:
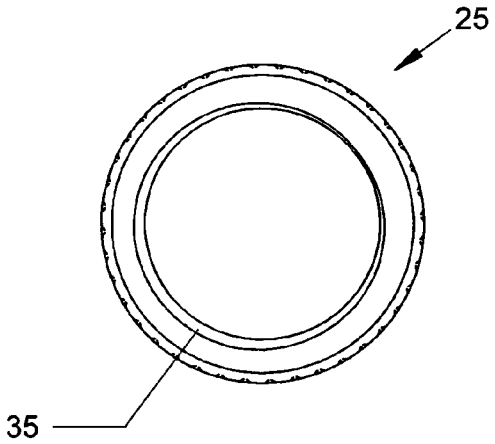
FIG. 12 is a front view of the thread protector of FIG. 11 along arrow 12X.
Figure 13:
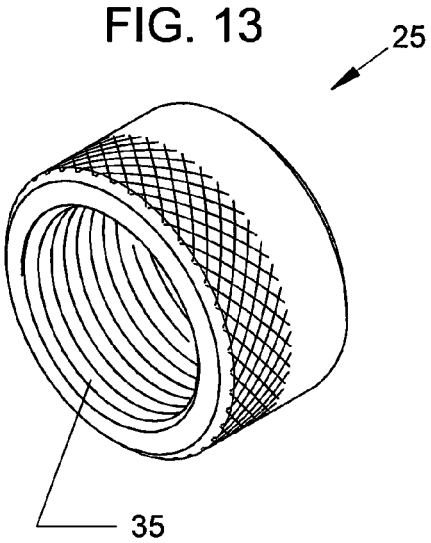
FIG. 13 is a bottom perspective view of the thread protector of FIG. 11.
Figure 14:
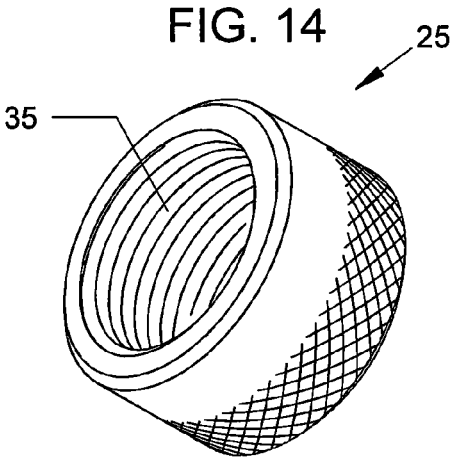
FIG. 14 is a top perspective view of the thread protector of FIG. 13.

FIG. 11 is an enlarged side view of the thread protector 25 used with the adapter system 1 of FIGS. 1-2. FIG. 12 is a front view of the thread protector 25 of FIG. 11 along arrow 12X. FIG. 13 is a bottom perspective view of the thread protector 25 of FIG. 11. FIG. 14 is a top perspective view of the thread protector 25 of FIG. 13.

Referring to FIGS. 1-14, the threaded protector 25 can be a hollow fully female threaded sleeve (from end to end) that fits the larger male threaded area 70 of the adapter 10 and is primarily intended to protect the large diameter threads 70 found on the center body of the adapter 10 when it is not in use. The threaded protector 25 advances to the back stop or nut 110 of the adapter 10 where it is held in place by tightening against that stop or nut. 110 Its' length can be exactly the length of the large male threads 70 of the adapter 10. The outside of the threaded protector (sleeve) 25 can have "flats", be smooth, and/or be knurled to provide a gripping surface for loosening or tightening. The threaded protector (sleeve) can be of a diameter large enough to slide over the muzzle brake 60.

Silencer Adapter 90

Figures 15, 16:
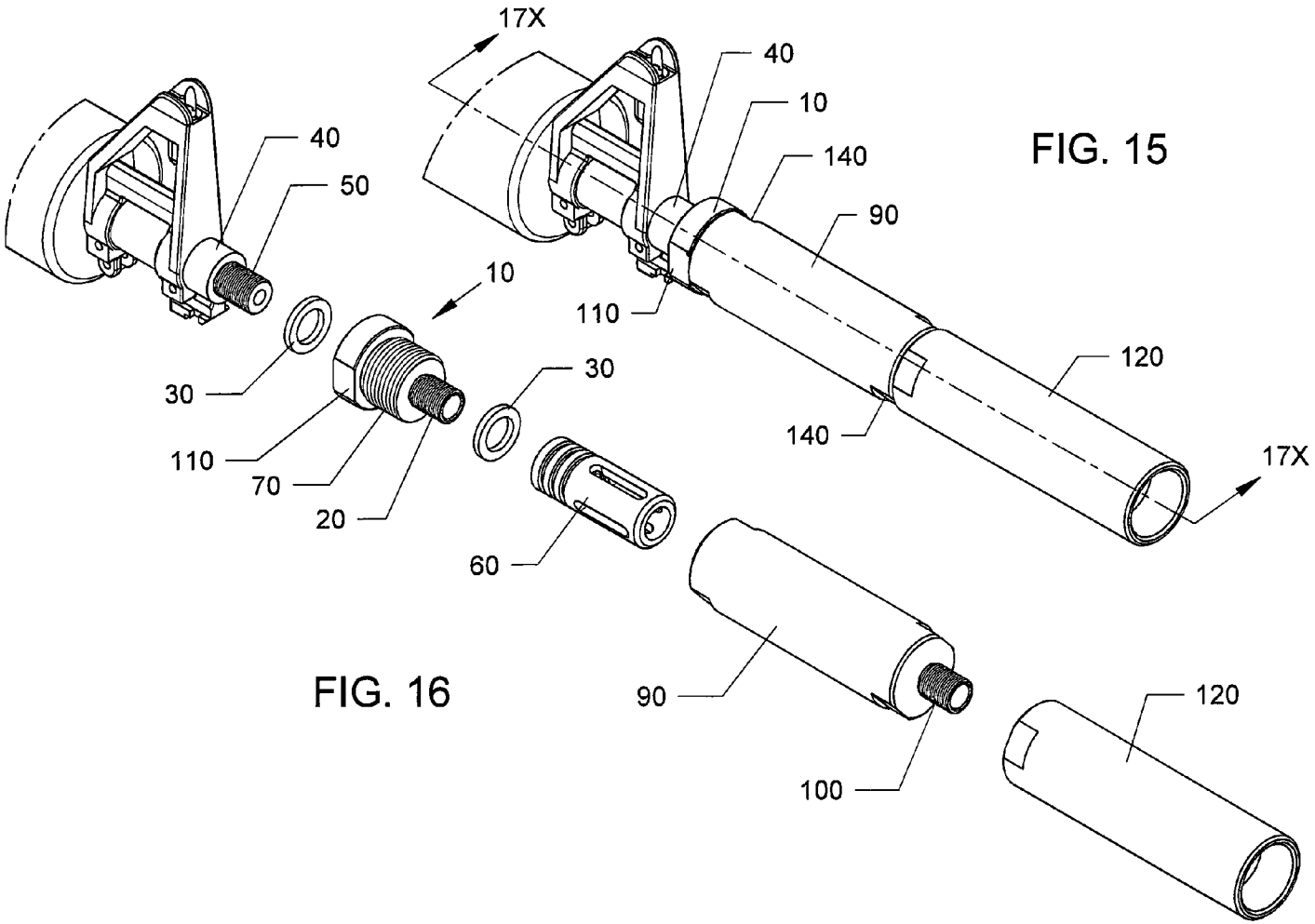
FIG. 15 is a top perspective assembled view of the universal integrated muzzle adapter mounted to the firearm barrel of FIGS. 1-2 with accessory silencer adapter paired with a prior art silencer.
FIG. 16 is an exploded view of adapter system adapter component, rifle barrel, accessory silencer adapter and prior art silencer of FIG. 15.
Figure 17:
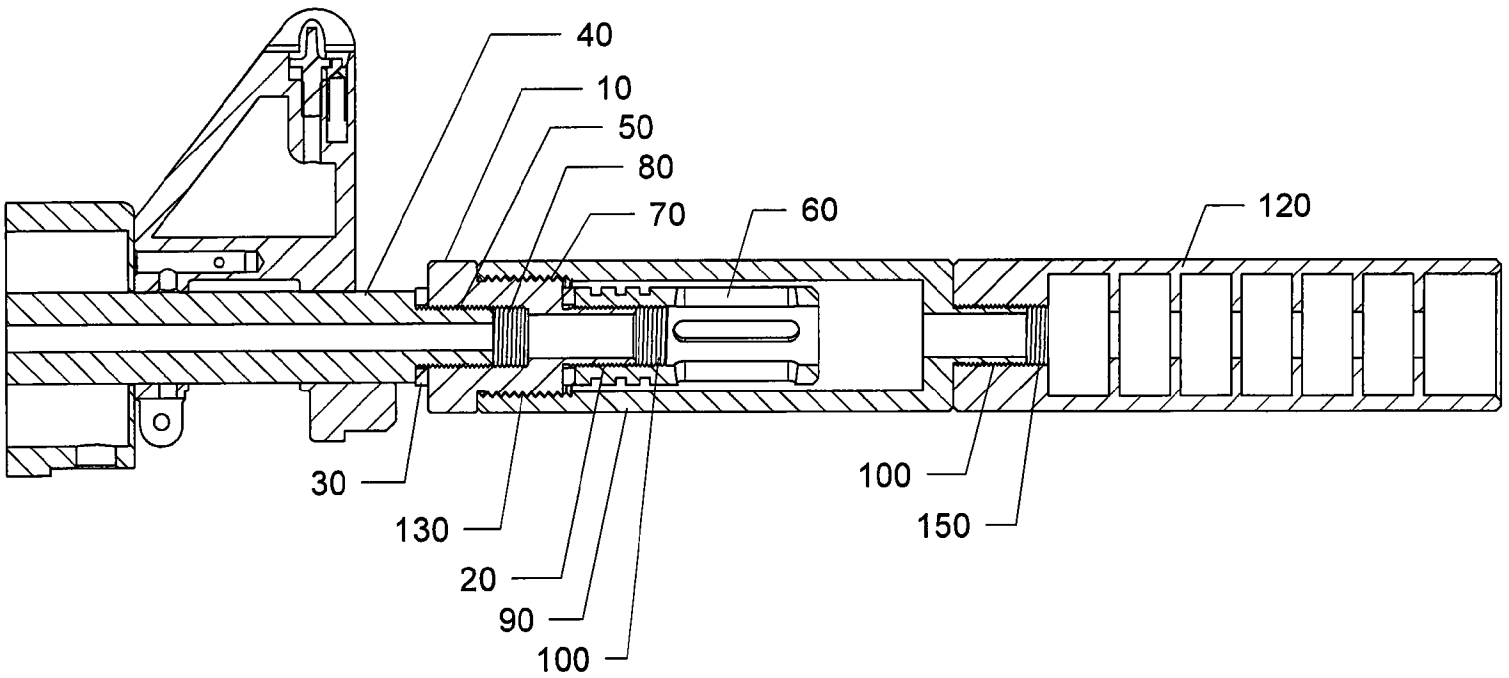
FIG. 17 is a cross-sectional view of the assembled adapter system adapter component mounted to the firearm barrel with accessory silencer adapter and prior art silencer of FIG. 15 along arrows 17X.

FIG. 15 is a top perspective assembled view of the muzzle adapter coupling system 10 mounted to the firearm barrel 40 of FIGS. 1-2 mounted to an accessory silencer adapter 90 and a prior art silencer 120. FIG. 16 is an exploded view of adapter system adapter component 10, rifle barrel 40, accessory silencer adapter 90 and prior art silencer 120 of FIG. 15. FIG. 17 is a cross-sectional view of the assembled adapter system adapter component 10 mounted to the firearm barrel 40 with accessory silencer adapter 90 and prior art silencer 120 of FIG. 15 along arrows 17X.

Referring to FIGS. 15-17, the crush washer(s) 30, adapter component 10 and muzzle brake 60 remain mounted to the accessory thread 50 on the rifle barrel 40 similar to that described in the previous figures. The thread protector (sleeve) 25 is not used here. First, the silencer adapter 90 can be attached or paired to the prior art silencer 120 and tightened via the novel silencer adapter flats or hex 140 creating a single paired device. This paired device is employed by attaching to the adapter 10 via the threaded socket end 130 on the novel silencer adapter 90 and rotated over the outside accessory threads 70 on the adapter 10 which may be tightened thereon by hand or via the flats 140 on the novel silencer adapter.

Figures 18, 19, 20, 21, 22:
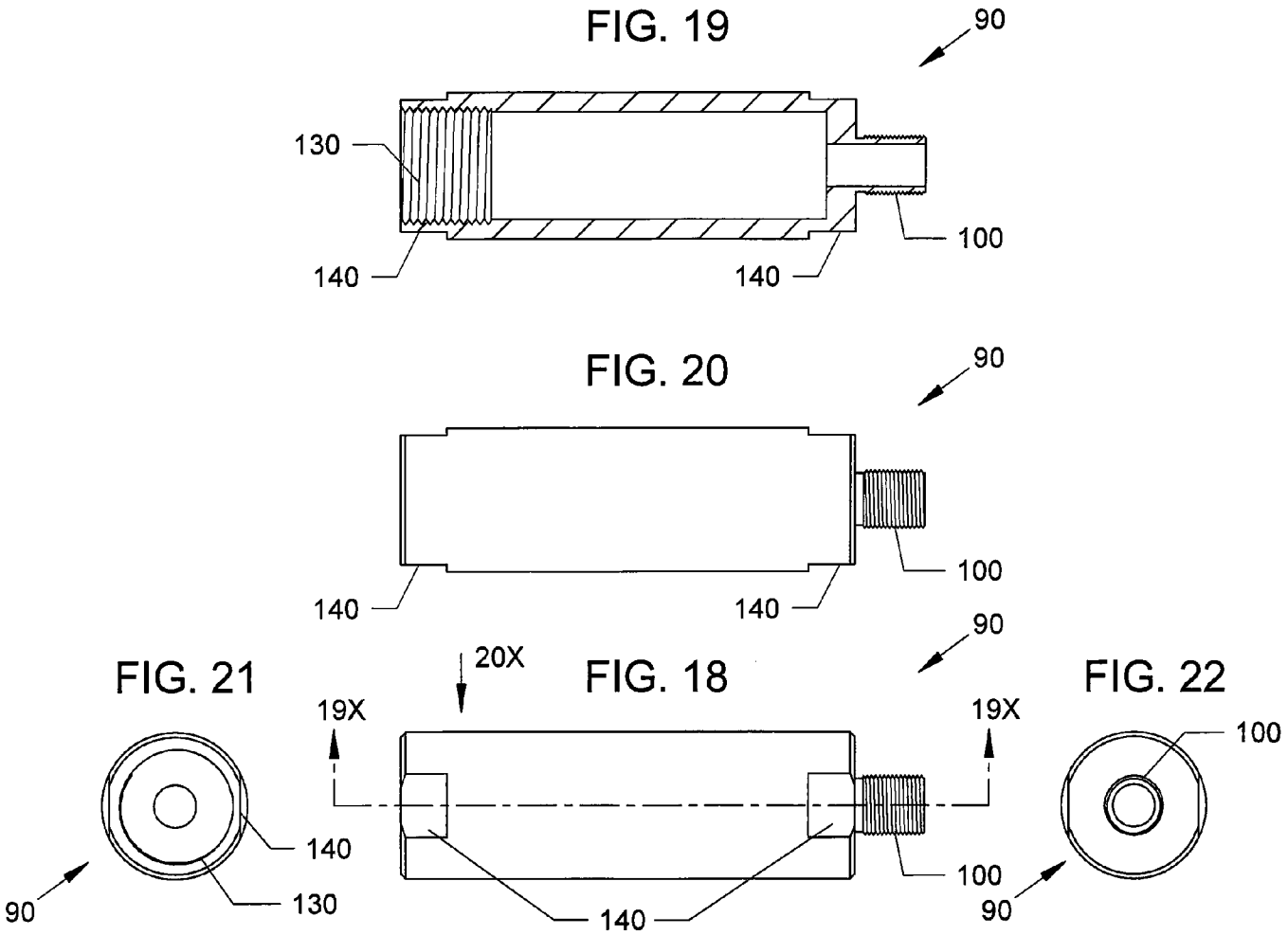
FIG. 18 is an enlarged front view of the silencer adapter of FIGS. 16-17.
FIG. 19 is a cross-sectional view of the silencer adapter of FIG. 18 along arrows 19X.
FIG. 20 is a top view of the silencer adapter of FIG. 18 along arrow 20X.
FIG. 21 is a left side view of the silencer adapter of FIG. 18.
FIG. 22 is a right side view of the silencer adapter of FIG. 18.
Figure 23:
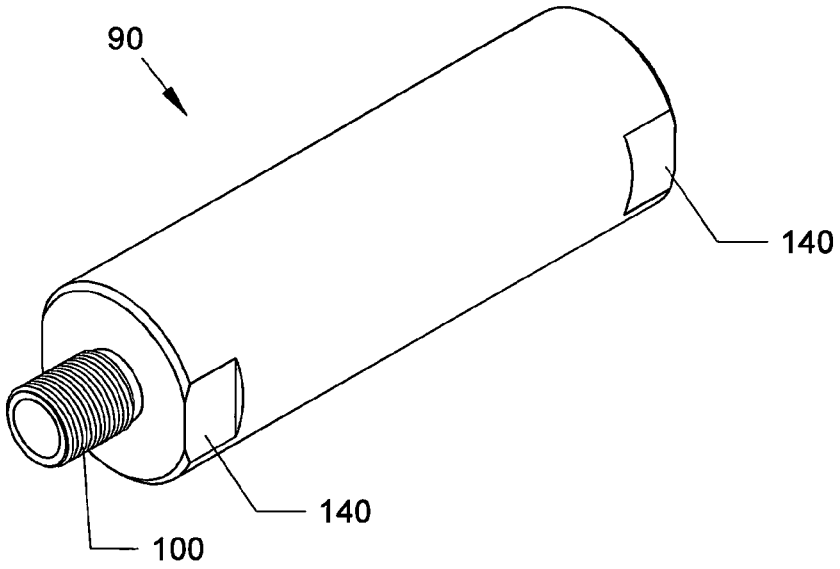
FIG. 23 is a top perspective view of the silencer adapter of FIGS. 18-22.
Figure 24:
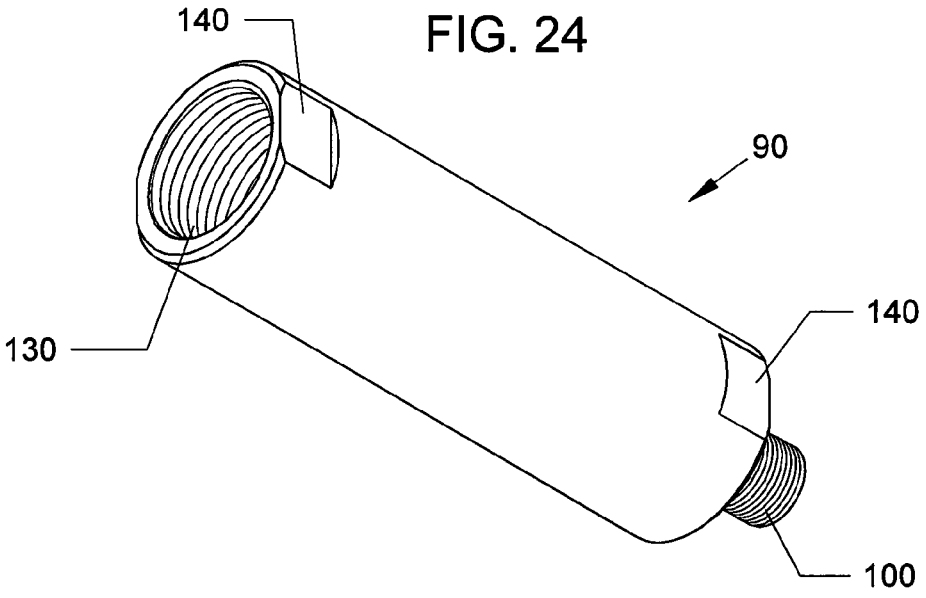
FIG. 24 is a bottom perspective view of the silencer adapter of FIG. 23.

FIG. 18 is an enlarged front view of the silencer adapter 90 of FIGS. 16-17. FIG. 19 is a cross-sectional view of the silencer adapter 90 of FIG. 18 along arrows 19X. FIG. 20 is a top view of the silencer adapter 90 of FIG. 18 along arrow 20X. FIG. 21 is a left side view of the silencer adapter 90 of FIG. 18. FIG. 22 is a right side view of the silencer adapter 90 of FIG. 18. FIG. 23 is a top perspective view of the silencer adapter 90 of FIGS. 18-22. FIG. 24 is a bottom perspective view of the silencer adapter 90 of FIG. 23.

Referring to FIGS. 15-24, the silence adapter is a barrel extension for allowing a silencer 120 to be attached thereon while a muzzle brake 60, flash hiders, muzzle suppressors is left on the rifle. This part of the invention can be a hollow cored tube having an end that interfaces or secures to the adapter 10. This end can have a female thread 130 that matches the adapter's large male thread 70 (located on the center body) so the part can be threadably advanced to secure it to the adapter and tightening against the back stops 110 of that threading (previously described). The outside surface can have flats 140 (such as notches), hex, be smooth, or be knurled to provide a gripping surface for loosening or tightening. The length of this part is intentionally longer than the muzzle brake so as to extend the barrel without interference from the muzzle brake. The outboard end of this part can be flat and closed except for the hollow cored male threaded stud 100 exactly matching the male threaded stud 50 on the rifle barrel 40 The silencer adapter 90 can have a larger diameter than the muzzle brake 60 allowing it to slide over the muzzle brake 60 and secure to the adapter's large threads 70 thereby extending the barrel 40. The silencer adapter 90 also does not interfere with passage of the projectile of the weapon whatsoever.

The adapter 10, accessory protector (sleeve) 25 and silencer adapter 90 can each be made of Stainless Steel, Carbon Steel (i.e. 12L14 steel as an example), or Aluminum. The parts can be run on a CNC machine to accommodate the specifications for the purpose of fitting to the barrel they are to be attached, to fit each other, to allow fitting of a host of accessory devices as purposed for or by the user, to allow the free passage of the weapons projectile without touching or interference whatsoever, to provide surfaces as necessary for the secure fastening of the invention and its parts as well as to the invention and its parts, and to accomplish aesthetic desirability via various finished treatments (i.e. Black Oxide, Mag-Phosphate, Black Nitride) and other ornamental variances/designs.

Percussion Shroud 160

Figures 25, 26:
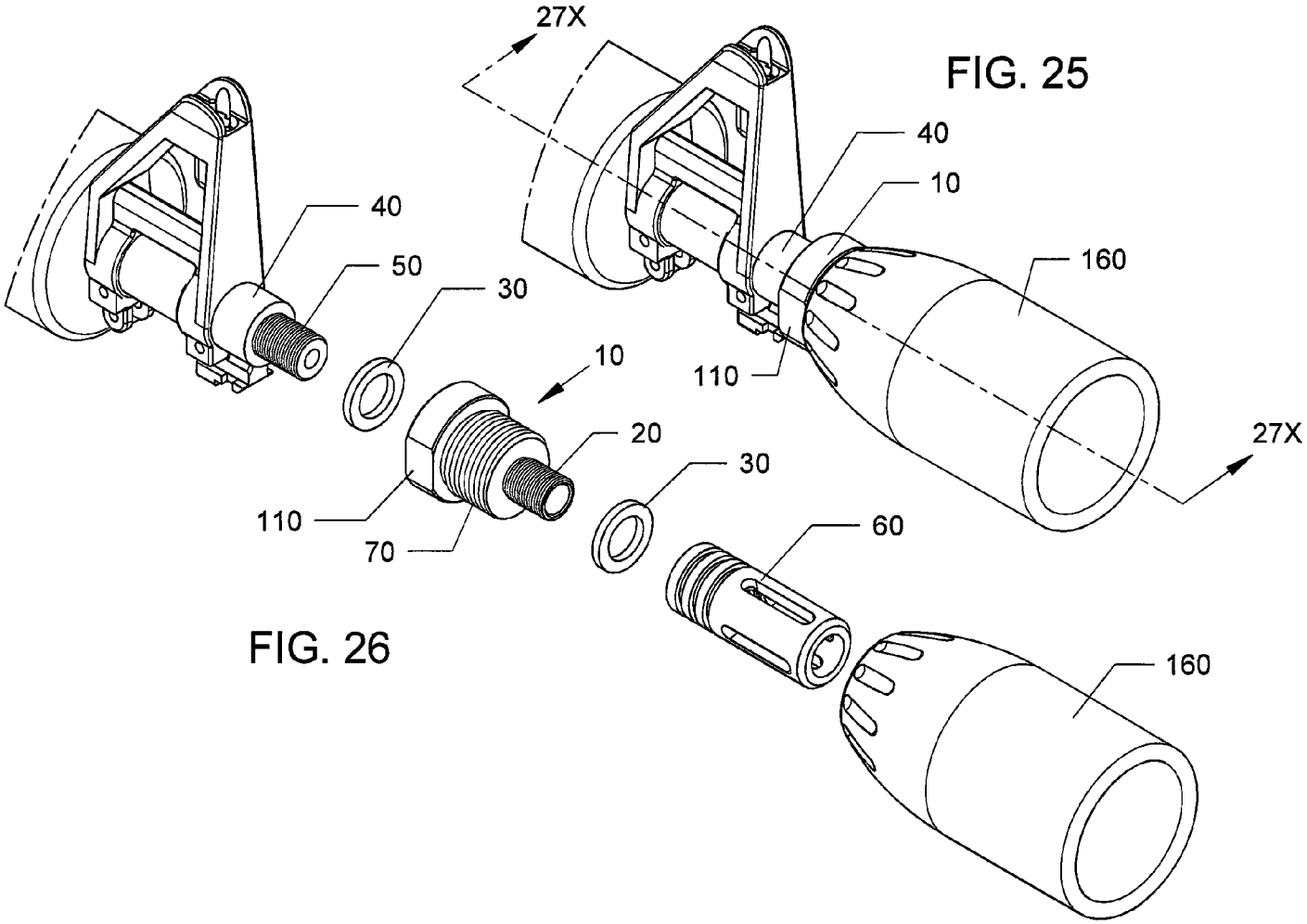
FIG. 25 is a top perspective assembled view of the muzzle adapter coupling system mounted to the firearm barrel of FIGS. 1-2 with accessory percussion shroud mounted.
FIG. 26 is an exploded view of the adapter component, firearm barrel and accessory percussion shroud of FIG. 25.
Figure 27:
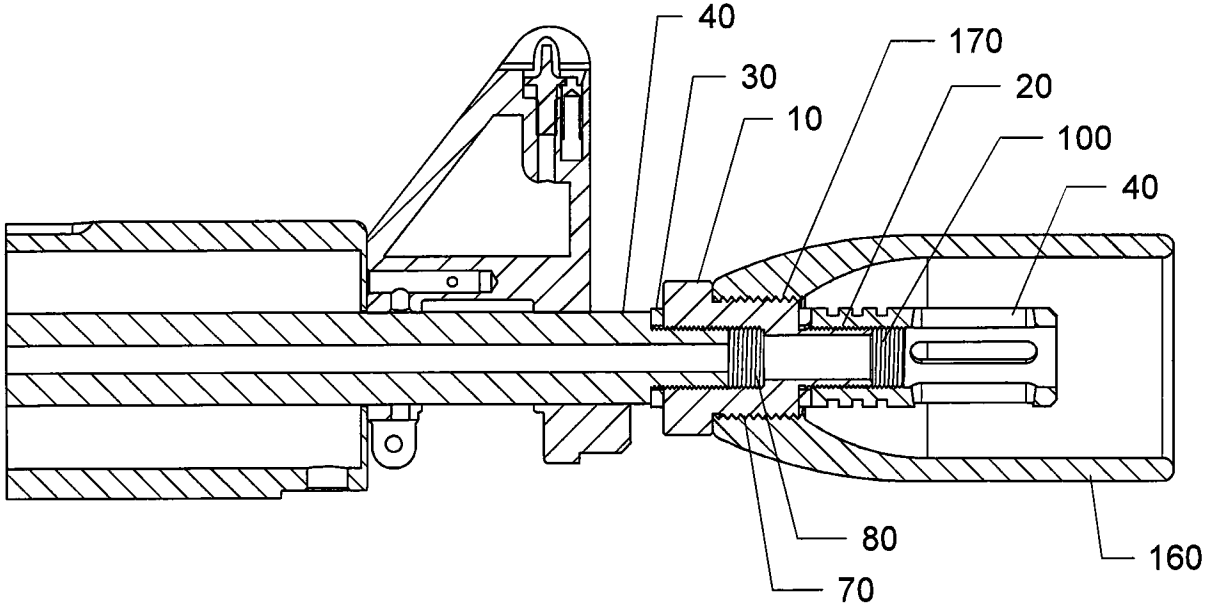
FIG. 27 is a cross-sectional view of the assembled adapter component mounted to the firearm barrel with accessory percussion shroud mounted of FIG. 25 along arrows 27X.

FIG. 25 is a top perspective assembled view of the adapter component 10 mounted to the firearm barrel 40 of FIGS. 1-2 with accessory percussion shroud 160 mounted. FIG. 26 is an exploded view of the adapter component 10, firearm barrel 40 and accessory percussion shroud 160 of FIG. 25. FIG. 27 is a cross-sectional view of the assembled adapter component 10 mounted to the firearm barrel 40 with accessory percussion shroud 160 mounted of FIG. 25 along arrows 27X.

Referring to FIGS. 25-27, the adapter 10, crusher washer(s) 30 and muzzle brake 60 can be mounted to the threaded stud portion of the rifle barrel 40 similar to those components mounted in the previous embodiments. Here, the threaded interior socket end 170 of the percussion shroud 160 is rotated over the outside accessory threads 70 on the adapter and tightened in place.

Cartridge Oil Filter 180

The novel adapter 10 can allow for solvent catching devices to be directly attached to the adapter's large threads 70 and be used clean your weapons mess free. These catch devices can slip over the terminal devices, such as the muzzle brakes, flash hiders, muzzle suppressors, and the like, and attach directly to all universal integrated muzzle adapter component 10 provisioned weapons. Available solvent catch devices such as oil filters, fuel filters and other such catch devices are easily attached to the large threaded exterior 70 of the adapter 10, and be used while camping, in the field, before leaving the gun range, or simply a mess free clean up while at home.

Figures 28, 29:
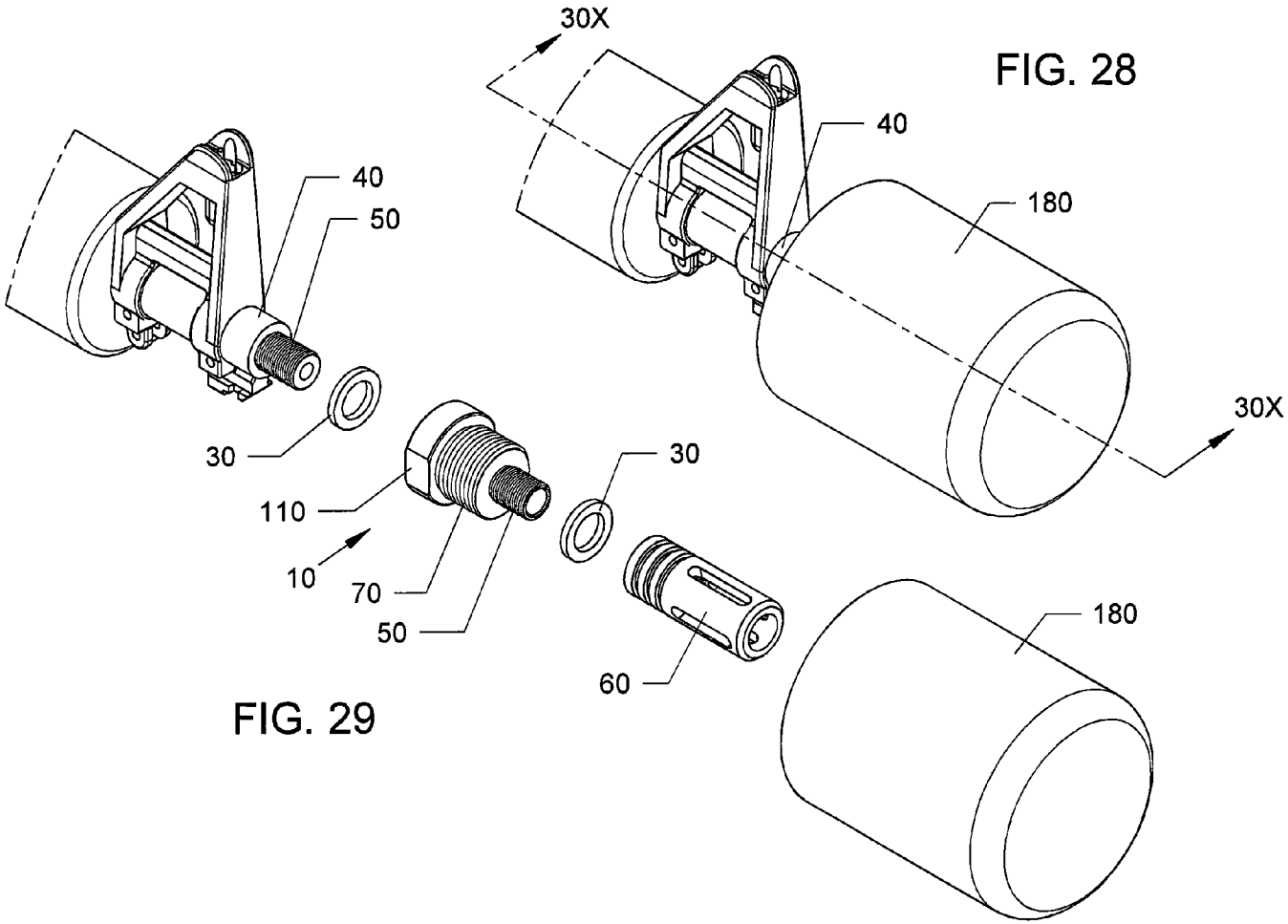
FIG. 28 is a top perspective assembled view of the muzzle adapter coupling system mounted to the firearm barrel of FIGS. 1-2 with accessory oil filter mounted for cleaning.
FIG. 29 is an exploded view of the assembled adapter component mounted to firearm with accessory oil filter of FIG. 28.
Figure 30:
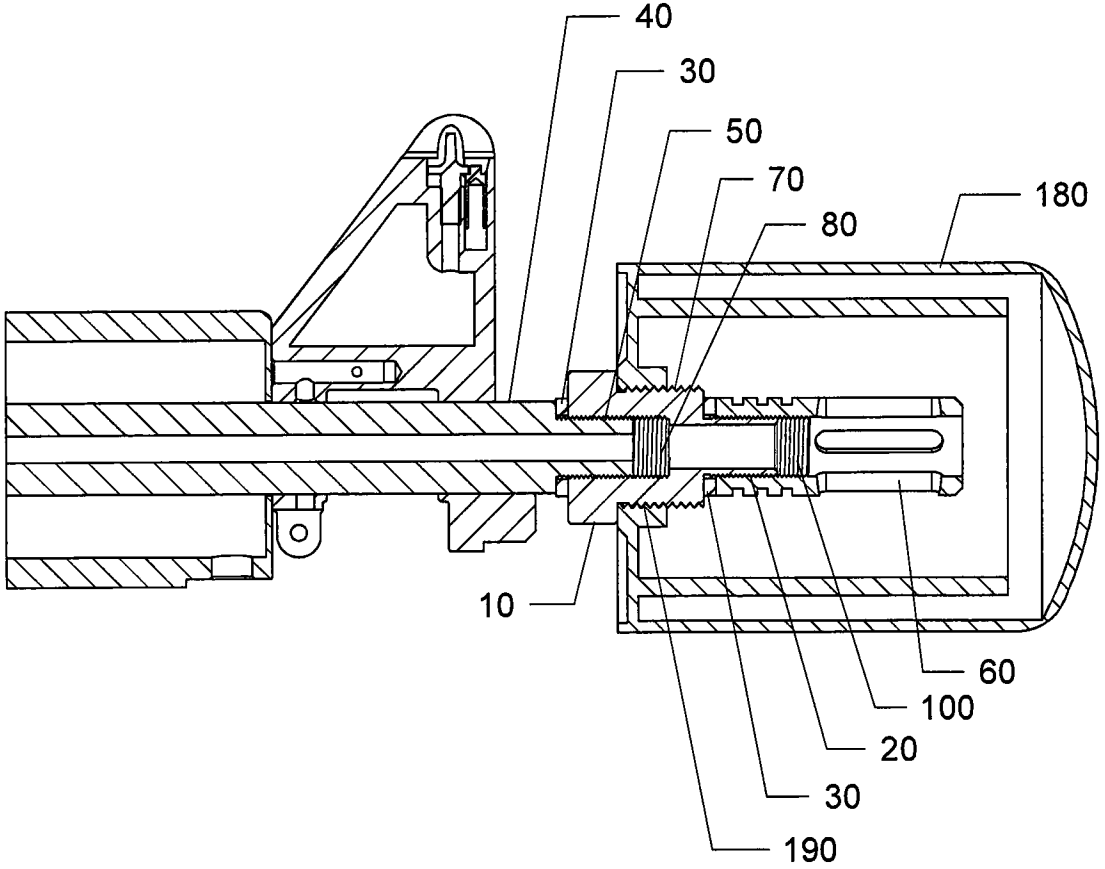
FIG. 30 is a cross-sectional view of the assembled adapter component mounted to firearm with accessory oil filter of FIG. 28 along arrows 30X.

FIG. 28 is a top perspective assembled view of the adapter component 10 mounted to the firearm barrel 40 of FIGS. 1-2 with accessory oil filter 180 mounted for cleaning. FIG. 29 is an exploded view of the assembled adapter component 10 mounted to firearm barrel 40 with accessory oil filter 180 of FIG. 28. FIG. 30 is a cross-sectional view of the assembled adapter component 10 mounted to firearm barrel 40 with accessory oil filter 180 of FIG. 28 along arrows 30X.

Referring to FIGS. 28-30, the adapter 10, crusher washer(s) 30 and muzzle brake 60 can be mounted to the threaded stud portion of the rifle barrel 40 similar to those components mounted in the previous embodiments. Here, the threaded interior socket end 190 of the oil filter 180 is rotated over the outside accessory threads 70 on the adapter and tightened in place.

The large threaded section of the adapter 10 allows for the attachment of other accessory devices such as bipods, flashlights, laser sights, and the like, freeing up valuable quad rail space or providing for redundancy. Some accessory devices can slip over the muzzle brakes, flash hiders, muzzle suppressors, and the like, and threadably advance till secured by tightening against the back stop.

Other ancillary accessory devices can be secured by their provided bracket which slips over the muzzle brakes, flash hiders, muzzle suppressors, and the like, and secures to the back stop by use of the accessory thread protector (sleeve) 25 or a provided nut. Accessory devices can provide a male indexing tab to reciprocally fit the female indexing notch provided at the 6 O'clock area of the back stop on the adapter 10 providing a positive locking alignment and angle as desired by the user.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An adapter system for attaching accessories to rifles, comprising:

a hollow adapter having a socket end with internal threads and an exterior grip portion about an exterior perimeter, the adapter having a first exterior threaded shaft having a first exterior diameter and a second exterior threaded shaft extending from the first exterior threaded shaft, the second exterior threaded shaft having an exterior diameter less than the first exterior diameter of the first exterior threaded shaft, wherein the socket end threadably attaches about accessory threads on a rifle barrel, so that a terminal device is adapted to remain on the rifle barrel when accessories are added to the rifle barrel.

2. The adapter system of claim 1, further comprising:

a first washer positioned between the socket portion of the adapter and the rifle barrel; and a second washer positioned between the second exterior threaded shaft and the terminal device.

3. The adapter system of claim 1, wherein the grip portion of the adapter includes flat sides.

4. The adapter system of claim 1, further comprising:

a sleeve protector having internal threads sized to mateably attach about the first exterior threaded shaft of the adapter.

5. The adapter system of claim 4, wherein the sleeve protector includes:

a smooth exterior surface.

6. The adapter system of claim 4, wherein the sleeve protector includes:

a knurled exterior surface.

7. The adapter system of claim 2, further comprising:

a sleeve protector having internal threads sized to mateably attach about the first exterior threaded shaft of the adapter.

8. The adapter system of claim 7, wherein the sleeve protector includes:

a smooth exterior surface.

9. The adapter system of claim 7, wherein the sleeve protector includes:

a knurled exterior surface.

10. The adapter system of claim 1, further comprising:

a hollow silencer adapter sleeve having a socket end with internal threads for rotating about the first exterior threaded shaft of the adapter, and a protruding end with an exterior threaded surface adapted to fit into a socket end of a gun barrel silencer.

11. The adapter system of claim 2, further comprising:

a hollow silencer adapter sleeve having a socket end with internal threads for rotating about the first exterior threaded shaft of the adapter, and a protruding end with an exterior threaded surface adapted to fit into a socket end of a gun barrel silencer.

12. An adapter system for allowing accessory devices to be attached to rifle barrels, while leaving terminal devices on the rifle barrel, comprising:

a hollow adapter having a socket end with internal threads and an exterior grip portion about an exterior perimeter, the adapter having a first exterior threaded shaft having a first exterior diameter and a second exterior threaded shaft extending from the first exterior threaded shaft, the second exterior threaded shaft having an exterior diameter less than the first exterior diameter of the first exterior threaded shaft, wherein the socket end threadably attaches about accessory threads on a rifle barrel, a terminal device attached to the second exterior threaded shaft, the terminal device selected from at least one of a muzzle brake, a flash hider and a muzzle suppressor; and an accessory device attached to the first exterior threaded shaft on the adapter.

13. The adapter system of claim 12, wherein the accessory device is an interior threaded protective sleeve for covering the first exterior threaded shaft.

14. The adapter system of claim 12, wherein the accessory device is a silencer adapter having a threaded socket end for rotating about and covering the first exterior threaded shaft of the adapter, and a protruding outer end having threaded surface for fitting within a threaded socket end of a silencer.

15. The adapter system of claim 12, wherein the accessory device is a percussion shroud having a threaded socket end for rotating about and covering the first exterior threaded shaft of the adapter.

16. The adapter system of claim 12, wherein the accessory device is a cartridge oil filter having a threaded socket end for rotating about and covering the first exterior threaded shaft of the adapter.

* * * * *